US008071516B2

(12) United States Patent
Kato et al.

(10) Patent No.: US 8,071,516 B2
(45) Date of Patent: Dec. 6, 2011

(54) LUBRICANTS FOR USE IN PROCESSING OF METALLIC MATERIAL

(75) Inventors: Mami Kato, Kariya (JP); Teruo Fukaya, Kariya (JP)

(73) Assignee: Toyota Boshoku Kabushiki Kaisha, Aichi-Ken (JP)

( * ) Notice: Subject to any disclaimer, the term of this patent is extended or adjusted under 35 U.S.C. 154(b) by 385 days.

(21) Appl. No.: 12/089,622

(22) PCT Filed: Oct. 26, 2006

(86) PCT No.: PCT/JP2006/321934

§ 371 (c)(1),
(2), (4) Date: Sep. 9, 2008

(87) PCT Pub. No.: WO2007/052733

PCT Pub. Date: May 10, 2007

(65) Prior Publication Data

US 2009/0247439 A1 Oct. 1, 2009

(30) Foreign Application Priority Data

Oct. 31, 2005 (JP) ..... 2005-316517

(51) Int. Cl.
*C10M 159/24* (2006.01)

(52) U.S. Cl. ..... 508/391; 508/392; 508/393

(58) Field of Classification Search ..... 508/391, 508/392, 393

See application file for complete search history.

(56) References Cited

U.S. PATENT DOCUMENTS

| | | | | |
|---|---|---|---|---|
| 4,201,681 | A * | 5/1980 | Lipinski et al. | 252/33.2 |
| 5,104,558 | A | 4/1992 | Matsuzaki | |
| 5,908,816 | A * | 6/1999 | Kobessho et al. | 508/391 |
| 6,562,766 | B1 * | 5/2003 | Koyama et al. | 508/372 |

FOREIGN PATENT DOCUMENTS

| | | |
|---|---|---|
| CN | 1186107 A | 7/1998 |
| GB | 1 383 198 | 2/1975 |
| JP | 3-047898 | 2/1991 |
| JP | 3-162492 | 7/1991 |
| JP | 7-42470 | 5/1995 |
| JP | 8-302490 | 11/1996 |
| JP | 8-311476 | 11/1996 |
| JP | 10-279979 | 10/1998 |
| JP | 10-280175 | 10/1998 |
| JP | 2002-3879 | 1/2002 |
| JP | 2004-323613 | 11/2004 |
| JP | 2008-56707 | 3/2008 |
| WO | 2005/095561 | 10/2005 |
| WO | 2006/095931 | 9/2006 |

OTHER PUBLICATIONS

Japanese Office Action dated Jul. 27, 2010 that issued with respect to patent family member Japanese Patent Application No. 2005-316517, along with an English language translation.
Japanese Office Action dated Apr. 20, 2010 that issued with respect to patent family member Japanese Patent Application No. 2005-316517, along with an English language translation.
English Language abstract of JP10-279979.
English Language abstract of WO 2005/095561.
English Language abstract of JP 7-42470.
English Language abstract of JP 8-311476.
English Language abstract of JP 2008-56707.
English Language abstract of WO 2006/095931.
U.S. Appl. No. 11/817,480, filed Aug. 30, 2007.
U.S. Appl. No. 11/845,461, filed Aug. 27, 2007.
U.S. Appl. No. 12/024,271, filed Feb. 1, 2008.
Chinese Office Action dated Jun. 7, 2011 that issued with respect to patent family member Chinese Patent Application No. 200680040448X, along with an English language translation.

* cited by examiner

*Primary Examiner* — Walter Griffin
*Assistant Examiner* — Francis C Campanell
(74) *Attorney, Agent, or Firm* — Greenblum & Bernstein, PLC

(57) ABSTRACT

A lubricant for use in processing of a metallic material includes a lubricant base and additives added to the lubricant base. The additives include a sulfuric extreme pressure agent, a rust inhibitive agent and a calcium ingredient. Content of sulfur contained in the sulfuric extreme pressure agent is not less than 0.5 wt % of total weight of the lubricant and not greater than 20 wt % of total weight of the lubricant. Content of the rust inhibitive agent is not less than 0.1 wt % of total weight of the lubricant and not greater than 15 wt % of total weight of the lubricant. Further, content of calcium contained in the calcium ingredient is not less than 0.1 wt % of total weight of the lubricant and not greater than 15 wt % of total weight of the lubricant.

6 Claims, No Drawings

LUBRICANTS FOR USE IN PROCESSING OF METALLIC MATERIAL

TECHNICAL FIELD

The present invention relates to lubricants for use in processing (i.e., press forming) of a metallic material, which lubricants have improved lubricity during the processing, excellent rust inhibiting performance after post-treatment (e.g., after welding), and self-removability during another post-treatment (e.g., during degreasing as pre-treatment of plating). More particularly, the present invention relates to lubricants for use in press forming of a high tensile strength steel sheet having tensile strength of 340 N/mm$^2$ or more, e.g., a cold-rolled steel sheet, a hot-rolled steel sheet and a plated steel sheet that are used for manufacturing automobile.

BACKGROUND ART

In recent years, there is a need to develop automobiles that have low environmental impact and increased safety. In a world of expanding globalization, car makers have advanced development of light and strong vehicle bodies as well as low emission engines and improved air bags. Automobile lightening has been progressed by reducing thickness of steel components without decreasing their strength. From the mid-1990s, a high tensile strength steel sheet that can be used as a metallic material which contributes to the lightening of an automobile has been a focus of attention.

Generally, strength of a steel sheet is expressed in tensile strength. A steel sheet having tensile strength of 340 N/mm$^2$ or more is referred to as a high tensile strength steel sheet. Conversely, a steel sheet having tensile strength of 280 N/mm$^2$ or less is referred to as a mild steel sheet. Recently, the high tensile strength steel sheet having a tensile strength of 1000 N/mm$^2$ or more has been used to enhance collision safety.

The high tensile strength steel sheet may also be referred to as "high strength steel sheet" or "high tensile material." However, Japanese Industrial Standard generally uses the term "high tensile strength steel sheet" in, for example, JIS G 3134 (which is directed to "processable hot rolled high tensile strength steel sheets and bands for mobile application") and JIS G 3135 (which is directed to "processable cold rolled high tensile strength steel sheets and bands for mobile application"). Therefore, in this description, "high tensile strength steel sheet" will be used hereinafter.

Generally, the high tensile strength steel sheet has increased intensity and increased yield strength. As a result, the high tensile strength steel sheet has reduced ductility, which is caused by the increased intensity. The reduced ductility may cause poor formability. Also, the high yield strength may inherently provide high spring back performance. Such high spring back performance may produce a number of defects in a product that is formed from the high tensile strength steel sheet by press forming. Such defects in the press formed product may include surface distortion, bad shape stability, cracking, reduced accuracy and galling. Thus, in order to reliably press form the high tensile strength steel sheet, there are a number of technical problems to be solved.

Recently, when a metallic material or steel sheet is processed (i.e., press formed), lubricants are generally omitted in order to reduce processing costs. In addition, after the steel sheet is processed, rust inhibitive oils are generally omitted. Therefore, if the steel sheet is press formed without using the lubricants, the steel sheet cannot be suitably press formed because of lack of lubricity, thereby producing cracking and galling in a formed product. Also, such lack of lubricity may increase friction between the steel sheet and forming dies. Such friction may significantly reduce service life of the forming dies.

In order to solve these problems, there is a need to develop lubricants or rust inhibitors that provide excellent lubricity during the press forming of the steel sheet. Up to now some special lubricants have been developed. For example, Japanese Laid-open Patent Publication Number 10-279979 teaches a rust inhibitive oil solution for use in the press forming of the steel sheet. This oil solution contains a rust inhibitive agent, ultrabasic calcium sulfonate, a sulfuric extreme pressure agent and potassium borate. However, this oil solution contains a boron compound (potassium borate) that is pertinent to Pollutant Release and Transfer Register (PRTR). Therefore, such an oil solution is negative from the viewpoint of environmental preservation. Also, Japanese Patent Publication Number 7-42470 or Japanese Laid-open Patent Publication Number 8-311476 teaches a rust inhibitive oil solution having kinetic viscosity of 40 mm$^2$/s or less at 40° C. This oil solution may have excellent rust inhibiting performance and self-removing performance. However, this oil solution has less lubricity. Therefore, such an oil solution is not suitable for processing (press forming) the high tensile strength steel sheet because the high tensile strength steel sheet may be subjected to extremely large stress.

Post-treatment of the press forming may, for example, include the steps of (1) degreasing and washing a formed product in order to remove lubricants, (2) applying the washed product with rust inhibitive oils in order to protect the product from rusting, (3) plating or coating the product, (4) treating the product by heat in order to strengthen the product, and (5) welding the product to another metal component.

In order to weld the high tensile strength steel sheet, a metal active gas (MAG) welding method using gaseous carbon dioxide ($CO_2$) as a shielding gas is often used. This welding method is one of many steel welding methods and is referred to as a $CO_2$-MAG welding method. The $CO_2$-MAG welding method is the most widely used arc welding method for welding steel. For example, the $CO_2$-MAG welding method is commonly used in many industries of, for example, pressure containers, bridge frames, constructional steel frames, ships, marine structures, heavy machinery, chemical plants, nuclear plants, motorcycles and automobiles. Generally, the $CO_2$-MAG welding method has advantages of increased welding speed, high welding efficiency and easy handling. Also, this welding method may provide high quality welding portions. Further, this welding method can be applied to metallic materials having a wide variety of thickness without changing a welding wire.

In the $CO_2$-MAG welding method, it is possible to use a pure gas of carbon dioxide and a mixed gas of argon and carbon dioxide as the shielding gas. However, the pure gas of carbon dioxide is a highly oxidized gas. Such an oxidized gas can oxidize and deteriorate a welding product (i.e., a welding composite constituted of a welding wire metal and a matrix steel) produced in the welding portions because the welding portions can be heated to about 1500° C. (i.e., a melting point of the welding wire) or more. The deteriorated welding product may reduce bonding strength of the welding portions. Therefore, when the $CO_2$-MAG welding method is used for welding the high tensile strength steel sheet, the mixed gas of argon and carbon dioxide may generally be used as the shielding gas in order to prevent the welding portions from excessively deteriorating. Preferably, the mixing ratio of argon to carbon dioxide is approximately 80:20.

Further, according to Japanese Industrial Standard, the $CO_2$-MAG welding method is simply referred to as a "MAG welding method" regardless of whether the shielding gas is the carbon dioxide pure gas or the argon-carbon dioxide mixed gas. Therefore, in order to mention the $CO_2$-MAG welding method, the "MAG welding method" will be used here on a nonexclusive basis. That is, herein, the "MAG welding method" will refer to both of the $CO_2$-MAG welding methods in which the carbon dioxide pure gas and the argon-carbon dioxide mixed gas are respectively used as the shielding gas.

In addition, when the high tensile strength steel sheet is welded by the MAG welding method, the MAG welding method is sometimes performed without removing the lubricants from the high tensile strength steel sheet. In such a case, the lubricants may decompose, thereby producing corrosive compounds. The produced corrosive compounds may produce corrosion on the welded product (i.e., weldment). The corrosion thus produced may deteriorate the weldment in quality.

Further, the lubricants must be removed from the press formed and welded product before the product is plated. Therefore, it is essential that the lubricants can be easily removed or washed out from the product.

DISCLOSURE OF INVENTION

It is, accordingly, one object of the present teachings to provide an improved lubricant for use in processing of a high tensile strength steel sheet having tensile strength of 340 $N/mm^2$ or more.

In one embodiment of the present teachings, a lubricant is taught for use in processing of a metallic material. The lubricant includes a lubricant base and additives added to the lubricant base. The additives include a sulfuric extreme pressure agent (Ingredient A), a rust inhibitive agent (Ingredient B) and a calcium ingredient (Ingredient C). Content of sulfur contained in Ingredient A is not less than 0.5 wt % of total weight of the lubricant and not greater than 20 wt % of total weight of the lubricant. Content of Ingredient B is not less than 0.1 wt % of total weight of the lubricant and not greater than 15 wt % of total weight of the lubricant. Further, content of calcium contained in Ingredient C is not less than 0.1 wt % of total weight of the lubricant and not greater than 15 wt % of total weight of the lubricant.

According to the present teachings, the lubricant may have improved performance superior to the conventional lubricant. That is, the lubricant may have improved lubricity when the metallic material is processed or press formed. Also, the lubricant may have excellent rust inhibiting performance after the press formed metallic material is welded. Further, when the press formed metallic material is washed as pretreatment of plating, the lubricant can be easily removed therefrom.

Other objects, features and advantages of the present teachings will be readily understood after reading the following detailed description together with the accompanying drawings and the claims.

BEST MODE FOR CARRYING OUT THE INVENTION

In the following, a detailed representative embodiment of the present teachings will be described.

A lubricant for use in processing of a metallic material may include a lubricant base and additives added to the lubricant base. In this embodiment, the additives may be a sulfuric extreme pressure agent (Ingredient A), a rust inhibitive agent (Ingredient B) and a calcium ingredient (Ingredient C).

First, the lubricant base of the lubricant will be described. In this embodiment, the lubricant base may be at least one member that is selected from the group consisting of mineral oils, synthetic oils and fatty oils. These oils may preferably include all mineral oils, synthetic oils and fatty oils that are known per se for use in a lubricant for processing a metallic material. In other words, these oils are not limited to special oils. However, the oils may preferably include oils that have kinetic viscosity of 1 $mm^2/s$ to 1000 $mm^2/s$ at 40° C., more preferably 5 $mm^2/s$ to 100 $mm^2/s$ at 40° C. Thus, the oils can be appropriately selected from the known oils, if necessary.

Examples of the mineral oils include many kinds of mineral oils that can be produced in a general petroleum refinery process. Such a petroleum refinery process may include the steps of distilling a crude petroleum under normal and reduced pressures so as to obtain a distillate, and further treating the obtained distillate via at least one of solvent deasphalting, solvent extraction, hydrocracking, solvent dewaxing, catalytic dewaxing, hydrorefining, sulfuric acid scrubbing and white earth treatment.

Examples of the synthetic oils are poly-α-olefins, α-olefin copolymers, poly butenes, alkyl benzenes, polyoxyalkyleneglycols, polyoxyalkyleneglycol ethers, silicone oils and other such compounds.

Examples of the fatty oils are beef fat, lard, soy been oil, canola oil, rice bran oil, coconut oil, palm oil, palm kernel oil and hydrogenated products thereof.

Next, the additives of the lubricant, i.e., the sulfuric extreme pressure agent (Ingredient A), the rust inhibitive agent (Ingredient B) and the calcium ingredient (Ingredient C) will be described.

In this embodiment, the sulfuric extreme pressure agent (Ingredient A) may preferably include various types of sulfuric compounds that can provide extreme pressure property. In other words, the sulfuric extreme pressure agent is not limited to special sulfuric compounds. Examples of the sulfuric extreme pressure agent are sulfurized fats, sulfurized fatty acids, sulfuric esters, sulfurized olefins, polysulfides, thiocarbamates and sulfurized mineral oils. Further, the sulfurized fats may preferably be made by reacting sulfur with various types of fats (e.g., a lard, whale oils, vegetable oils and fish oils). The sulfurized fats may include a sulfurized lard, a sulfurized canola oil, a sulfurized caster oil and a sulfurized soy been oil. In addition, the sulfurized fatty acids may include a sulfide of oleic acid. Also, the sulfuric esters may include a sulfide of methyl oleate and a sulfide of octyl rice bran fatty acid.

The sulfurized olefins may preferably be produced by reacting $C_2$-$C_{15}$ olefins or their multimers (e.g., dimers, trimers or tetramers) with a sulfurize agent such as sulfur and sulfur chloride.

Examples of the polysulfides are dibenzylpolysulfides, di-tert-nonylpolysulfides, didodecylpolysulfides, di-tert-butylpolysulfides, dioctylpolysulfides, diphenylpolysulfides and dicyclohexylpolysulfides.

Examples of the thiocarbamates are zinc thiocarbamates, dilaurylthiodipropionates and distearylthiodipropionates.

The sulfurized mineral oils may preferably be produced by dissolving elementary sulfur into mineral oils. The mineral oils for use in preparation of the sulfurized mineral oils may be, for example, but are not limited to, the same mineral oils as the mineral oils for use in the lubricant base.

Moreover, the sulfuric extreme pressure agent (Ingredient A) may include sulfur atom containing organozinc compounds. Examples of the organozinc compounds are zinc dialkyldithiophosphate (which will be referred to ZnDTP hereinafter) and zinc dialkyldithiocarbamic acid (which will be referred to ZnDTC hereinafter). Alkyl groups contained in ZnDTP and ZnDTC may be identical with or different from each other. That is, in ZnDTP, two alkyl groups bonding to a phosphorus atom via an oxygen atom may be identical with or different from each other. Similarly, in ZnDTC, two alkyl groups bonding to a nitrogen atom may be identical with or different from each other. The alkyl groups contained in ZnDTP and ZnDTC may preferably be alkyl groups having a carbon number of three or more. Further, these alkyl groups can be replaced by aryl groups.

In the present invention, the above-described compounds for the sulfuric extreme pressure agent can be used in either a pure form or in a combined form. Further, the sulfuric extreme pressure agent may preferably be added to the lubricant base such that sulfur content in the formulated lubricant is not less than 0.5 wt % of total weight of the lubricant and not greater than 20 wt % of total weight of the lubricant, more preferably not less than 2 wt % and not greater than 15 wt %. If the sulfur content in the formulated lubricant is less than 0.5 wt % of total weight of the lubricant, the lubricant may have insufficient lubricity. On the contrary, if the sulfur content in the formulated lubricant is greater than 20 wt % of total weight of the lubricant, the lubricant may have sufficient or superior lubricity. However, the lubricant may instead have inferior rust inhibiting performance after the metallic material having the lubricant is welded by a MAG welding method.

The rust inhibitive agent (Ingredient B) is not limited to special compounds. Examples of the rust inhibitive agent are sulfonates or sulfonic acid compounds of calcium (Ca), barium (Ba) and sodium (Na), ester compounds of oxidized waxes, oxidized wax compounds (e.g., Ca-, Ba- and Na-salts of the oxidized waxes), polyalcohol esters (e.g., solbitanmonooleate), lanolin, and metallic soap of lanolin. However, the compounds containing Ca or Ba are more preferred. In this invention, the above-described compounds for the rust inhibitive agent can be used in either a pure form or in a combined form. Generally, the rust inhibitive agent may be mixed with mineral oils, synthetic oils and various types of esters, so as to be easily dissolved into the lubricant base.

In the present invention, content of the rust inhibitive agent in the lubricant is not less than 0.1 wt % of total weight of the lubricant and not greater than 15 wt % of total weight of the lubricant, more preferably not less than 1 wt % and not greater than 10 wt %. If the content of the rust inhibitive agent in the formulated lubricant is less than 0.1 wt % of total weight of the lubricant, the lubricant may have insufficient rust inhibiting performance after the metallic material having the lubricant is welded by the MAG welding method. On the contrary, even if the content of the rust inhibitive agent in the formulated lubricant is increased to be greater than 15 wt % of total weight of the lubricant, the lubricant may only have limited effects.

The calcium ingredient (Ingredient C) may include, but are not limited to, calcium sulfonates, calcium salicylates and calcium phenates. However, the calcium sulfonates are preferred in terms of kinetic viscosity and price. More preferred are basic calcium sulfonates. Further more preferred are highly-basic calcium sulfonates having base value of 300 mgKOH/g or more.

In this invention, the above-described compounds for the calcium ingredient can be used in either a pure form or in a combined form. Further, calcium content in the lubricant is not less than 0.1 wt % of total weight of the lubricant and not greater than 15 wt % of total weight of the lubricant, more preferably not less than 0.2 wt % and not greater than 10 wt %. If the calcium content in the formulated lubricant is less than 0.1 wt % of total weight of the lubricant, the lubricant may have insufficient lubricity. On the contrary, if the calcium content in the formulated lubricant is greater than 15 wt % of total weight of the lubricant, the lubricant may only have limited effects.

As described above, the additives for use in the preparation of the lubricant essentially consist of the sulfuric extreme pressure agent (Ingredient A), the rust inhibitive agent (Ingredient B) and the calcium ingredient (Ingredient C). Various types of known additional agents can be added to the lubricant without obscuring the object of the invention in order to increase or stabilize basic properties of the lubricant, if necessary.

The known agents may include an antioxidizing agent, a corrosion prevention agent, a coloring agent, an antifoaming agent and a fragrant material. Examples of the antioxidizing agent are amine series compounds and phenolic compounds. Examples of the corrosion prevention agent are benzotriazols, tolyltriazols and mercaptobenzothiazoles. Further, the coloring agent may be various types of dyes and pigments.

The lubricant may preferably be formulated so as to have kinetic viscosity of not less than 50 $mm^2/s$ at 40° C. and not greater than 200 $mm^2/s$ at 40° C. The lubricant having such a special range of kinetic viscosity may provide excellent lubricity when the metallic material is processed (e.g., press formed). At the same time, such a lubricant may exhibit excellent rust inhibiting performance after the processed metallic material is welded. In addition, such a lubricant may have improved self-removability when the welded metallic material is washed. As will be appreciated, the kinetic viscosity of the lubricant may generally depend on the types and combination of the oils for use in the lubricant base. Therefore, it is possible to easily control the kinetic viscosity of the lubricant so as to fall within such a special range by simply selecting the types and combination of the oils.

The lubricant of the present invention may have beneficial effects in various processing of the metallic material, e.g., press forming, punching, half die cutting, bending, drilling, burring, shaving and tapping each of which can be performed by means of a special processing tool. Also, the lubricant does not contain chlorine components. Therefore, the lubricant may have rust inhibiting performance greater than the prior art lubricant. That is, the lubricant may effectively prevent the processing tool and the processed metallic material from rusting. In addition, the lubricant can be applied to various types of metallic materials, e.g., stainless steel, alloy steels, carbon steels and aluminum alloys. The lubricant may provide particularly beneficial effects when applied to a high tensile strength steel sheet having tensile strength of 340 $N/mm^2$ or more.

The lubricant may be applied between the processing tool and the metallic material in order to lubricate therebetween. To this end, the lubricant may be applied to the metallic material by means of, for example, but are not limited to, a roller and a sprayer. The lubricant thus applied may effectively increase processing accuracy of a processing machine of the metallic material. In addition, the lubricant that is applied between the processing tool and the metallic material may effectively protect the processing tool from rusting and damaging, thereby providing a prolonged working life of the processing tool.

The examples of the lubricant of the present invention will now be described. Further, the following examples are illustrative and should not be construed as limitations of the invention.

Nine example lubricants (Examples 1-9) were prepared by utilizing the following additives. Compositions of the nine types of lubricants (Examples 1-9) are shown in Table 1.

(a) The sulfuric extreme pressure agent (Ingredient A)
a1: polysulfides (30 wt % sulfur content)
a2: sulfurized fats (15 wt % sulfur content)
a3: ZnDTP (16 wt % sulfur content)
(b) The rust inhibitive agent (Ingredient B)
b1: barium sulfonates
b2: oxidized wax compounds
b3: calcium sulfonates
b4: metallic soap of lanolin
b5: sulfonic acid compounds
(c) The calcium ingredient (Ingredient C)
c1: highly-basic calcium sulfonates (15 wt % calcium content)
(d) Other additives (Ingredient D)
d1: chlorinated paraffins (50 wt % chlorine content)

TABLE 1

| | Examples | | | | | | | | |
|---|---|---|---|---|---|---|---|---|---|
| | 1 | 2 | 3 | 4 | 5 | 6 | 7 | 8 | 9 |
| Lubricant Base | 53.5 | 53.5 | 53.5 | 52.2 | 52.2 | 52.2 | 48.9 | 48.9 | 48.9 |
| a1 | 5 | 5 | 5 | 5 | 5 | 5 | 5 | 5 | 5 |
| a2 | 25 | 25 | 25 | 25 | 25 | 25 | 25 | 25 | 25 |
| a3 | 10 | 10 | 10 | 10 | 10 | 10 | 10 | 10 | 10 |
| b1 | 0.4 | 0.4 | 0.4 | 1.1 | 1.1 | 1.1 | 0.7 | 0.7 | 0.7 |
| b2 | 0.6 | 0.6 | 0.6 | 1.2 | 1.2 | 1.2 | 1.1 | 1.1 | 1.1 |
| b3 | 0.4 | 0.4 | 0.4 | 0.4 | 0.4 | 0.4 | 1.4 | 1.4 | 1.4 |
| b4 | 0.1 | 0.1 | 0.1 | 0.1 | 0.1 | 0.1 | 1.4 | 1.4 | 1.4 |
| b5 | | | | | | | 1.5 | 1.5 | 1.5 |
| c1 | 5 | 5 | 5 | 5 | 5 | 5 | 5 | 5 | 5 |
| d1 | | | | | | | | | |
| Sulfur Content (%) | 6.8 | 6.8 | 6.8 | 6.8 | 6.8 | 6.8 | 6.8 | 6.8 | 6.8 |
| Rust Inhibitive Agent Content (%) | 1.5 | 1.5 | 1.5 | 2.8 | 2.8 | 2.8 | 6.1 | 6.1 | 6.1 |
| Calcium Content (%) | 0.75 | 0.75 | 0.75 | 0.75 | 0.75 | 0.75 | 0.75 | 0.75 | 0.75 |
| Kinetic Viscosity at 40° C. ($mm^2/s$) | 80 | 100 | 150 | 80 | 100 | 150 | 80 | 100 | 150 |

In preparation of the lubricants, various types of materials were used as the lubricant base. In Examples 1-3, the types of the lubricant base materials and the combination ratios thereof were appropriately changed such that each of Examples 1-3 has a different kinetic viscosity at 40° C. Similarly, in Examples 4-6, the types of the lubricant base materials and the combination ratios thereof were changed such that each of Examples 4-6 has a different kinetic viscosity at 40° C. Further, in Examples 7-9, the types of the lubricant base materials and the combination ratios thereof were changed such that each of Examples 7-9 has a different kinetic viscosity at 40° C.

Further, three control lubricants (Controls 1-3) were prepared by utilizing the above-described additives. These three control lubricants (Controls 1-3) thus prepared substantially corresponded to commercially available typical lubricants for use in press forming. Also, three additional control lubricants (Controls 4-6) were provided. These three lubricants were two commercially available lubricative rust inhibitive oils for steel and a commercially available rust inhibitive oil for steel. Compositions of these six control lubricants (Controls 1-6) are shown in Table 2.

TABLE 2

| | Controls | | | | | |
|---|---|---|---|---|---|---|
| | 1 | 2 | 3 | 4 | 5 | 6 |
| Lubricant Base | 45 | 13 | 40 | * | ** | *** |
| a1 | | 5 | | | | |
| a2 | | 20 | 40 | | | |
| a3 | | 12 | 20 | | | |
| b1 | 5 | | | | | |
| b2 | | | | | | |
| b3 | | | | | | |
| b4 | | | | | | |
| b5 | | | | | | |
| c1 | | 50 | | | | |
| d1 | 50 | | | | | |
| Sulfur Content (%) | — | 7.2 | 9.2 | | | |
| Rust Inhibitive Agent Content (%) | 5 | — | — | | | |

TABLE 2-continued

| | Controls | | | | | |
|---|---|---|---|---|---|---|
| | 1 | 2 | 3 | 4 | 5 | 6 |
| Calcium Content (%) | — | 7.5 | — | | | |
| Kinetic Viscosity at 40° C. ($mm^2/s$) | 110 | 135 | 125 | 40 | 20 | 5 |

* Commertially available lubricative rust inhibitive oil A for steel
** Commertially available lubricative rust inhibitive oil B for steel
*** Commertially available rust inhibitive oil for steel In Tables 1 and 2, the content of each ingredient was expressed as a weight part. The sulfur content (%) was expressed as a weight percent of sulfur atom contained in Ingredient A to the total weight of each lubricant. Similarly, the calcium content (%) was expressed as a weight percent of calcium atom contained in Ingredient C to the total weight of each lubricant. Further, the rust inhibitive agent content (%) was expressed as a weight percent of Ingredient B to the total weight of each lubricant.

With regard to the lubricants of Examples 1-9 and Controls 1-6, a lubrication performance evaluation test was performed. In order to perform the lubrication performance evaluation test, the work pieces having the lubricants were respectively processed, so as to produce formed articles (test pieces).

Preparation of the Formed Articles was Carried Out Under Following Conditions.

Processing Machine 500 ton progressive pressing machine (FUKUI) having a punch and dies Production speed: 45 spm Material of the punch: SKD11

Material of the dies: SKD11

Work Pieces

1. High tensile strength steel sheets having tensile strength of 440 N/mm$^2$

Thickness: 1.0 mm

2. High tensile strength steel sheets having tensile strength of 590 N/mm$^2$

Thickness: 1.8 mm

3. High tensile strength steel sheets having tensile strength of 780 N/mm$^2$

Thickness: 1.2 mm

4. High tensile strength steel sheets having tensile strength of 980 N/mm$^2$

Thickness: 1.0 mm

Application of the Lubricants

The lubricants of Examples 1-9 and Controls 1-6 were uniformly fed to the surfaces of the work pieces by a resin roll coater.

Processing

The work pieces having the lubricants were respectively subjected to sixteen types of processing (e.g., punching, bending, drilling, burring and tapping), thereby producing the formed articles (test pieces) that can be used as parts of a vehicle reclining seat. These processing were carried out simultaneously or successively.

The formed articles thus formed were measured in order to determine dimensional accuracy thereof (i.e., processing accuracy of the processing machine). From the measured value, the dimensional accuracy of the articles were evaluated based on the following reference levels:

Superior: Meeting dimensional standards

Inferior: Not meeting dimensional standards

In addition, the punch and the dies were visually observed for the surface appearance thereof, so as to determine occurrence of wear. From the appearance, the punch and the dies were evaluated based on the following reference levels:

Superior: No wear

Inferior: Wear

Results are shown in Table 3.

TABLE 3

| | Dimensional Accuracy of Formed Articles | Appearance of Punch and Dies |
|---|---|---|
| Example 1 | Superior | Superior |
| Example 2 | Superior | Superior |
| Example 3 | Superior | Superior |
| Example 4 | Superior | Superior |
| Example 5 | Superior | Superior |
| Example 6 | Superior | Superior |
| Example 7 | Superior | Superior |
| Example 8 | Superior | Superior |
| Example 9 | Superior | Superior |
| Control 1 | Superior | Superior |
| Control 2 | Superior | Superior |
| Control 3 | Superior | Superior |
| Control 4 | Inferior | Inferior |
| Control 5 | Inferior | Inferior |
| Control 6 | Inferior | Inferior |

Table 3 demonstrates that according to the lubricants of Examples 1-9 and Controls 1-3, the work pieces can be reliably processed, so that the formed articles can be formed with superior dimensional accuracy. That is, the lubricants of these examples and controls may produce the formed articles having a smooth cut surface (shear surface) free from burrs and shear drops and having predetermined dimensions. In addition, it is demonstrated that the lubricants of Examples 1-9 and Controls 1-3 may effectively prevent the punch and the dies (i.e., processing tools) from wearing during processing. That is, the lubricants of these examples and controls may effectively prevent the punch and the dies from galling, seizing and damaging during processing. These results mean that each of the lubricants of Examples 1-9 and Controls 1-3 may have superior lubrication performance.

To the contrary, Table 3 demonstrates that according to the lubricants of Controls 4-6, the work pieces cannot be reliably processed. Therefore, the formed articles cannot be formed with allowable dimensional accuracy. That is, the lubricants of these controls may produce the formed articles having an undesirable rough cut surface (shear surface). These results mean that each of the lubricants of Controls 4-6 may have inferior lubrication performance.

Next, with regard to the lubricants of Examples 1-9 and Controls 1-6, a rust inhibition performance evaluation test was performed. In order to perform the rust inhibition performance evaluation test, the work pieces coated with the lubricants were welded utilizing the MAG welding method, so as to produce welded articles (test pieces).

The MAG welding was performed under following conditions.

Shield Gas

Mixed gas of argon and carbon dioxide (argon to carbon dioxide=80:20)

Wire Diameter 1.0 mm and 1.2 mm

Current, Voltage and Velocity

145 A, 16V and 60 cm/min

Torch Angle, Welding Length and Welding Width

60 °, 40 mm and 10 mm

Work Pieces

1. SPCC steel sheets

Thickness: 1.2 mm

2. High tensile strength steel sheets having tensile strength of 590 N/mm$^2$

Thickness: 1.8 mm

The welded articles thus formed were stored in a test chamber with constant temperature and humidity (a temperature of 50° C.; a humidity of 95%) for 960 hours. The stored welded articles were visually observed, so as to determine occurrence of rusting thereon (in particular, so as to determine a ratio of rusting area relative to the surface area of the article). From the observation, rust inhibition performance of the lubricants was evaluated based on the following reference levels:

Superior: The ratio of rusting area less than 10%

Inferior: The ratio of rusting area not less than 10%

Results are shown in Table 4.

TABLE 4

| | Rust Inhibition Performance | |
|---|---|---|
| | Welded Articles Formed from Work Pieces 1 | Welded Articles Formed from Work Piece 2 |
| Example 1 | Superior | Superior |
| Example 2 | Superior | Superior |
| Example 3 | Superior | Superior |
| Example 4 | Superior | Superior |
| Example 5 | Superior | Superior |
| Example 6 | Superior | Superior |
| Example 7 | Superior | Superior |

TABLE 4-continued

| | Rust Inhibition Performance | |
|---|---|---|
| | Welded Articles Formed from Work Pieces 1 | Welded Articles Formed from Work Piece 2 |
| Example 8 | Superior | Superior |
| Example 9 | Superior | Superior |
| Control 1 | Inferior | Inferior |
| Control 2 | Inferior | Inferior |
| Control 3 | Inferior | Inferior |
| Control 4 | Inferior | Inferior |
| Control 5 | Inferior | Inferior |
| Control 6 | Inferior | Inferior |

Table 4 demonstrates that all of the lubricants of Examples 1-9 have superior rust inhibition performance for the welded articles.

To the contrary, all of the lubricants of Controls 1-6 have inferior rust inhibition performance for the welded articles. Presumably, such inferior rust inhibition performance results from melting of the additives due to welding heat. Further, in the welded articles having the lubricant of Control 1 that contains a chlorine-based additive, the ratio of rusting area was substantially 100%. This means that the lubricant of Control 1 has extremely inferior rust inhibition performance than the lubricants of remaining controls (Controls 2-6).

Next, with regard to the lubricants of Examples 1-9 and Controls 1-6, a self-removing performance evaluation test was performed. In order to perform the self-removing performance evaluation test, the work pieces were coated with the lubricants. The work pieces coated with the lubricants were used as test pieces for this test.

The test pieces for the self-removing performance evaluation test were prepared as follows.

Work Pieces

1. SPCC steel sheets
   Dimension: 60 mm×80 mm×1.2 mm
2. Actual parts of a vehicle reclining seat that are formed from high tensile strength steel sheets having tensile strength of 590 N/mm$^2$
   Thickness: 1.8 mm Application of the Lubricants The lubricants of Examples 1-9 and Controls 1-6 were fed to the surfaces of the work pieces by a brush. The lubricant coated work pieces were left at a room temperature for 24 hours.

Further, an aqueous cleaning liquid for this test was formulated as follows.

Cleaning Agent

Commercially available surface treatment agent for steel (which can form an iron phosphate thin film on a steel surface during washing)

Concentration of Cleaning Agent

4% (Diluted by tap water)

The test pieces thus formed were washed in the cleaning liquid that is heated to 60° C. Washing operation was continued for 180 seconds by dipping while the cleaning liquid is stirred. After washing, the washed test pieces were took out from the cleaning liquid and visually observed, so as to determine surface wettability thereof (in particular, so as to determine a ratio of wetting area relative to the surface area of each test pieces). From the observation, self-removing performance of the lubricants was evaluated based on the following reference levels:

Superior: The ratio of wetting area not less than 80%

Inferior: The ratio of wetting area less than 80%

Results are shown in Table 5.

TABLE 5

| | Self-Removing Performance | |
|---|---|---|
| | Welded Articles Formed from Work Pieces 1 | Welded Articles Formed from Work Piece 2 |
| Example 1 | Superior | Superior |
| Example 2 | Superior | Superior |
| Example 3 | Superior | Superior |
| Example 4 | Superior | Superior |
| Example 5 | Superior | Superior |
| Example 6 | Superior | Superior |
| Example 7 | Superior | Superior |
| Example 8 | Superior | Superior |
| Example 9 | Superior | Superior |
| Control 1 | Superior | Superior |
| Control 2 | Inferior | Inferior |
| Control 3 | Inferior | Inferior |
| Control 4 | Superior | Superior |
| Control 5 | Superior | Superior |
| Control 6 | Superior | Superior |

Table 5 demonstrates that all of the lubricants of Examples 1-9 have superior self-removing performance. This means that the lubricants of Examples 1-9 can be easily removed from a steel surface.

To the contrary, the lubricants of Controls 2 and 3 have inferior self-removing performance. That is, the lubricants of Controls 2 and 3 cannot be easily removed from the steel surface.

As will be apparent from these results, the lubricants of the present invention may have superior lubrication performance when they are used for processing the high tensile strength steel sheets having tensile strength of 340 N/mm$^2$ or more. In addition, the lubricants of the present invention may have superior rust inhibition performance for the steel sheets that are welded by the MAG welding method. Further, the lubricants of the present invention may have superior self-removing performance for the steel sheets.

A representative embodiment of the present invention has been described in detail. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the foregoing detail description may not be necessary to practice the invention in the broadest sense, and are instead taught merely to particularly describe detailed representative examples of the invention. Moreover, the various features taught in this specification may be combined in ways that are not specifically enumerated in order to obtain additional useful embodiments of the present teachings.

The invention claimed is:

1. A lubricant for use in press forming of a high tensile strength steel sheet, comprising:

a lubricant base, and additives added to the lubricant base, the additives comprising (a) a sulfuric extreme pressure agent, (b) a rust inhibitive agent, and (c) a highly basic calcium sulfonate wherein content of sulfur contained in the sulfuric extreme pressure agent is not less than 2 wt % of total weight of the lubricant and not greater than 15 wt % of total weight of the lubricant, wherein content of the rust inhibitive agent is not less than 1 wt % of total weight of the lubricant and not greater than 10 wt % of total weight of the lubricant, wherein the content of calcium in the highly-basic calcium sulfonate is not less than 0.2 wt % of the total weight of the lubricant and not greater than 10 wt % of the total weight of the lubricant;

the highly-basic calcium sulfonate has a base value of 300 mg KOH/g or more;

the sulfuric extreme pressure agent comprises one or more polysulfides, one or more sulfurized fats, and zinc dialkyldithiophosphate (ZnDTP);

the rust inhibitive agent comprises one or more barium sulfonates, one or more oxidized wax compounds, one or more calcium sulfonates having a base values less than the highly-basic calcium sulfonate, and one or more metallic soaps of lanolin; and the lubricant has a kinetic viscosity of not less than 50 $mm^2/s$ at 40° C. and not greater than 200 $mm^2/s$ at 40° C.

2. The lubricant according to claim 1, wherein the lubricant is capable of processing a high tensile strength steel sheet having tensile strength of 340 $N/mm^2$ or more.

3. The lubricant according to claim 1, wherein the content of the rust inhibitive agent is in the range of 1.5 wt % to 6.1 wt % of total weight of the lubricant.

4. The lubricant according to claim 3, wherein the content of sulfur is 6.8 wt % of total weight of the lubricant.

5. The lubricant according to claim 4, wherein the content of calcium is 0.75 wt % of total weight of the lubricant.

6. The lubricant according to claim 1, wherein the rust inhibitive agent further comprises sulfonic acid compounds.

* * * * *